US008499936B2

(12) United States Patent
Albrecht et al.

(10) Patent No.: US 8,499,936 B2
(45) Date of Patent: Aug. 6, 2013

(54) PRODUCT PACKAGING SYSTEM WITH BUTTON LOCK RELEASE

(75) Inventors: Kregg Albrecht, Pleasant Prairie, WI (US); Robert E. Gaumont, Sun Prairie, WI (US)

(73) Assignee: Nosco, Inc., Gurnee, IL (US)

( * ) Notice: Subject to any disclaimer, the term of this patent is extended or adjusted under 35 U.S.C. 154(b) by 0 days.

(21) Appl. No.: 13/419,110

(22) Filed: Mar. 13, 2012

(65) Prior Publication Data

US 2012/0234701 A1 Sep. 20, 2012

Related U.S. Application Data

(60) Provisional application No. 61/452,738, filed on Mar. 15, 2011.

(51) Int. Cl.
*B65D 50/06* (2006.01)

(52) U.S. Cl.
USPC ..... 206/528; 206/531

(58) Field of Classification Search
USPC ..... 206/528, 531, 540, 538, 1.5, 468
See application file for complete search history.

(56) References Cited

U.S. PATENT DOCUMENTS

| | | | |
|---|---|---|---|
| 752,463 | A | 2/1904 | Morris |
| 2,790,587 | A | 4/1957 | Contant |
| 3,095,479 | A | 6/1963 | Le Blan |
| 3,129,817 | A | 4/1964 | Rohdin |
| 3,610,410 | A | 10/1971 | Seeley |
| 3,809,220 | A | 5/1974 | Arcudi |
| 3,809,221 | A | 5/1974 | Compere |
| 3,811,564 | A | 5/1974 | Braber |
| 3,835,995 | A | 9/1974 | Haines |
| 3,872,970 | A | 3/1975 | Edison |
| 3,899,080 | A | 8/1975 | Brunda |
| 3,905,479 | A | 9/1975 | Gerner et al. |
| 3,912,081 | A | 10/1975 | Haines et al. |
| 3,912,082 | A | 10/1975 | Gerner et al. |
| 3,921,805 | A | 11/1975 | Compere |
| 3,924,746 | A | 12/1975 | Haines |
| 3,924,747 | A | 12/1975 | Gerner |
| 3,941,248 | A | 3/1976 | Moser et al. |
| 4,011,949 | A | 3/1977 | Braber et al. |
| 4,120,400 | A | 10/1978 | Kotyuk |
| 4,125,190 | A | 11/1978 | Davie, Jr. et al. |

(Continued)

FOREIGN PATENT DOCUMENTS

| | | |
|---|---|---|
| EP | 1 002 744 A1 | 5/2000 |
| WO | 2007/059245 | 5/2007 |

*Primary Examiner* — Steven A. Reynolds
*Assistant Examiner* — King M Chu
(74) *Attorney, Agent, or Firm* — Schiff Hardin LLP

(57) ABSTRACT

A lockable product package assembly containing an outer sleeve and an inner tray slidably engaged within the outer sleeve. The outer sleeve includes a tray locking recess disposed in an inner surface of a first wall of the outer sleeve. The inner tray includes a product portion with a protruding release button and a locking portion integrally connected to the product portion. The locking portion of the tray is configured to engage with the tray locking recess in the outer sleeve, so as to prevent sliding movement of the tray relative to the sleeve, when the inner tray is fully inserted into the outer sleeve. To release the tray, the protruding release-button on the inner tray is depressed, which disengages the locking portion of the tray from the locking recess in the outer sleeve, so as to permit sliding movement of the tray relative to said outer sleeve.

11 Claims, 9 Drawing Sheets

U.S. PATENT DOCUMENTS 4,192,422 A 3/1980 Kotyuk
4,231,477 A 11/1980 De Felice
RE30,958 E 6/1982 White
4,437,566 A 3/1984 Szahler
4,485,915 A 12/1984 Berghahn
4,506,789 A 3/1985 Dlugosz
4,535,890 A 8/1985 Artusi
4,589,549 A 5/1986 Hehn
4,595,156 A 6/1986 Bridenbaugh et al.
4,972,953 A 11/1990 Friedman et al.
5,046,618 A 9/1991 Wood
5,064,664 A 11/1991 Hustad et al.
5,082,702 A 1/1992 Alband
5,088,599 A 2/1992 Mahler
5,103,979 A 4/1992 Hustad
5,172,812 A 12/1992 Wharton et al.
5,275,291 A * 1/1994 Sledge ..... 206/531
5,310,060 A 5/1994 Bitner et al.
5,351,991 A 10/1994 McDonald
5,458,374 A 10/1995 Vijuk et al.
5,529,188 A 6/1996 Coggswell
5,680,782 A 10/1997 Komatsu et al.
5,820,165 A 10/1998 Verenski
6,003,903 A 12/1999 Verenski
6,032,795 A 3/2000 Ehrlund et al.
6,047,829 A 4/2000 Johnstone et al.
6,230,893 B1 5/2001 Karow
6,375,956 B1 4/2002 Hermelin et al.
6,412,636 B1 7/2002 Jones et al.
6,435,561 B1 8/2002 Verenski
6,460,693 B1 * 10/2002 Harrold ..... 206/1.5
6,491,211 B1 * 12/2002 Evans et al. ..... 229/102
6,516,949 B2 2/2003 Fuller et al.
6,523,691 B2 2/2003 Raj et al.
6,641,031 B2 * 11/2003 Evans et al. ..... 229/102
6,682,879 B2 1/2004 Conk
6,752,272 B2 6/2004 Jones et al.
6,832,686 B2 12/2004 Donegan
6,874,636 B2 4/2005 Paliotta et al.
6,926,161 B2 8/2005 Miceli et al.
7,004,312 B2 * 2/2006 Chen ..... 206/39.5
7,090,079 B2 8/2006 Ehrlund
7,658,287 B2 * 2/2010 Hession ..... 206/528
7,798,328 B2 * 9/2010 Hession ..... 206/531
7,845,495 B2 12/2010 Baker et al.
7,967,144 B2 * 6/2011 Sack et al. ..... 206/538
8,066,121 B2 * 11/2011 Sack et al. ..... 206/531
8,132,671 B2 * 3/2012 Hession ..... 206/470
2003/0064381 A1 4/2003 Feder et al.
2003/0085262 A1 * 5/2003 Evans et al. ..... 229/102
2003/0230501 A1 12/2003 Smolev
2004/0045858 A1 3/2004 Harrold
2004/0099565 A1 5/2004 Dehlin et al.
2004/0262189 A1 12/2004 Fraser et al.
2007/0068843 A1 * 3/2007 Hession ..... 206/538
2007/0251983 A1 * 11/2007 Freeze ..... 229/125.125
2007/0272586 A1 * 11/2007 Hession ..... 206/532
2008/0093252 A1 * 4/2008 Hession ..... 206/531
2009/0014350 A1 1/2009 Gaumont
2011/0011765 A1 * 1/2011 Gelardi et al. ..... 206/531
2012/0168342 A1 * 7/2012 Hession ..... 206/531

* cited by examiner 1
150
100
118
126
112
2Pull
152
151
153
160
158
154
162
120
116
122
124
156
ish

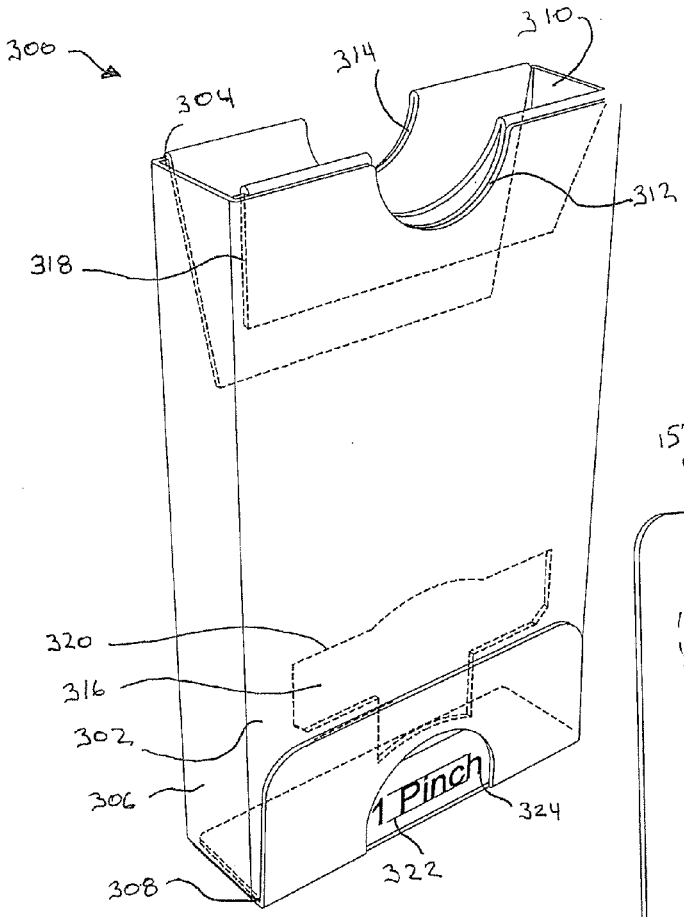
FIG. 10
FIG. 11
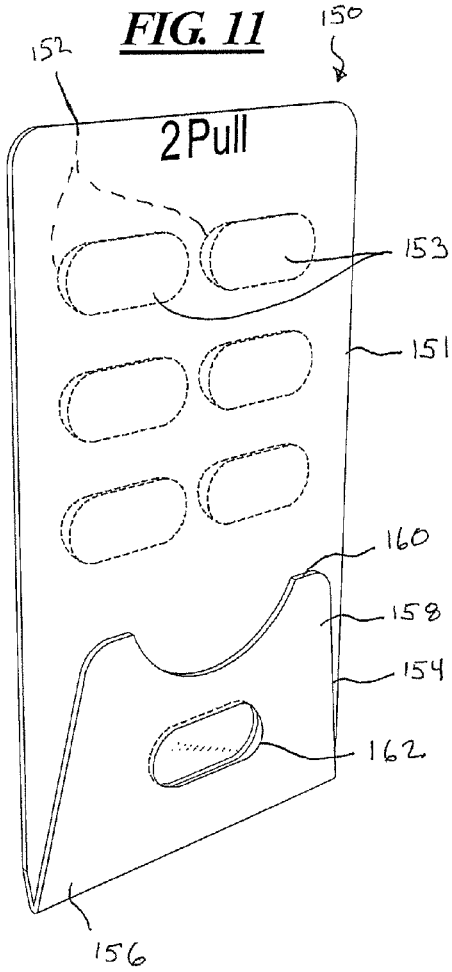

2 Pull
2 Pull
1 Pinch
1 Pinch
350
318
319
352
354
304
201

PRODUCT PACKAGING SYSTEM WITH BUTTON LOCK RELEASE

CROSS-REFERENCE TO RELATED APPLICATIONS

This application claims priority to U.S. Provisional Application Ser. No. 61/452,738 filed Mar. 15, 2011, the entire contents of which is hereby incorporated by reference herein.

FIELD

The present disclosure relates to a child-resistant, senior-friendly, lockable product package used to securely hold products, and in particular to a child-resistant and senior-friendly packaging for medications, medical products, and the like.

BACKGROUND

Product packaging for products like medications are typically either child-resistant or senior-friendly, but not both. Children of the age groups intended to be prevented from opening child-resistant packaging typically have limited ability to combine two distinct motions into one movement, such as applying a force to press down on one part of a package while at the same time rotating the same or another part of the package. For example, to open a typical child-resistant pill bottle often requires a user to apply a large downward force directly on a cap of the pill bottle, so that the latches in the cap clear the lugs disposed on the top edge of the bottle, and then rotate the bottle cap while maintaining the downward force on the cap. The force required to push downward on the cap to open these types of bottles is often so large that it is even difficult for senior-citizens, as well as children, to open the bottles. In addition, other child-resistant pill bottles do not require that the entire cap be pressed downward, but do require that a large cantilevered latch disposed in the edge of the bottle neck be pressed downward to move a latching lug out of engagement from the corresponding lugs in the bottle cap. This cantilevered latch is short and fairly stiff, and often times, the significant amount of force required to depress the latch is greater than many seniors are capable of applying. Accordingly, these types of packages unintentionally end up being both child and senior resistant, as opposed to being child-resistant and senior-friendly.

Other methods used to open additional typical product packages include: squeezing two depressed areas on a cap while rotating the cap, which requires significant strength; pulling on a ring, which requires both strength and dexterity; breaking off an individual sealed product blister from the rest of the blisters and tearing the plastic blister open to access the product inside, all of which requires considerable strength and dexterity; and pushing a product, like a pill, through a child-resistant film/foil, which requires both strength and dexterity.

Accordingly, there is a need for a product package that is both child-resistant and easy to open such that it is senior-citizen friendly.

SUMMARY

Some embodiments of the invention provide a packaging system containing child-resistant and senior-friendly features. Within the scope of this invention is an integral product package lock system.

This and other objects of the present disclosure are to provide a product package lock system, formed into a single integrated package, which is released from a locked condition through the use of a release button mechanism. The principles of the present disclosure are to be broadly applied to any integrated package with a lock system released by any type of release button mechanism.

According to preferred embodiments of the invention, an outer sleeve, containing an integral locking mechanism, and an inner tray are formed out of paperboard or synthetic materials or any combination thereof. The tray may contain unit dose packaging and products, such as medications, liquid or dry fill packaging in all types of containers including blisters, bottles, pouches, syringes, vials and sachets. In one embodiment, the tray includes blisters enclosing pills or other products.

In a first preferred embodiment, the integral locking mechanism is created by the interaction between a recesses formed in an interior surface of an outer sleeve and a flap-shaped locking portion extending from an inner tray. The unlocking mechanism is formed as a protrusion or raised release button disposed on the inner tray, which when depressed causes the locking portion on the tray to disengage from the recess in the sleeve. The inner tray can then be slid forward, exposing the products contained in the tray. Sliding the inner tray completely back inside of the outer sleeve locks the tray back inside the sleeve by re-engaging the locking portion of the tray within the recess of the sleeve, thus returning the product package assembly to the original locked and child-resistant condition.

BRIEF DESCRIPTION OF THE DRAWINGS

The present disclosure is described in detail below with reference to the attached drawing figures, wherein:

FIG. 10 is an isometric projection view of a second embodiment of an outer sleeve, assembled from the flat layout of FIG. 9, of a lockable package assembly disclosed herein, wherein certain interior features of the sleeve are shown in phantom line view.

FIG. 11 is an isometric projection view of an embodiment of an assembled inner tray of a lockable package assembly disclosed herein, the tray containing a protruding release button and blisters for holding pills or other products.

DETAILED DESCRIPTION

Figure 1:
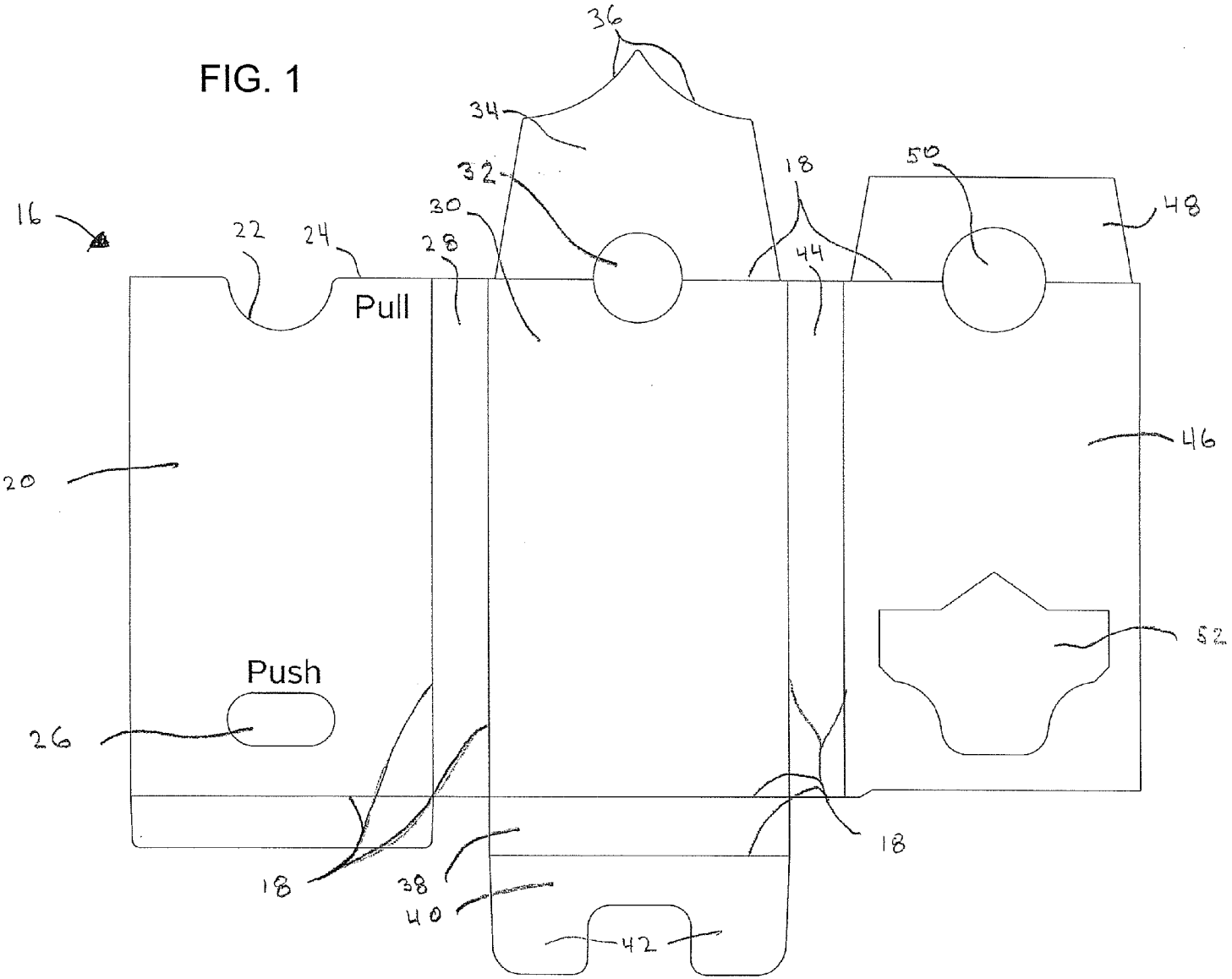
FIG. 1 is a plan view, showing cut and fold locations, of a flat sleeve layout that can be folded to form an outer sleeve of the lockable package of a first embodiment.

While the present invention is capable of embodiment in various forms, there is shown in the drawings, and will be hereinafter described, one or more presently preferred embodiments with the understanding that the present disclosure is to be considered as an exemplification of the invention, and is not intended to limit the invention to the specific embodiments illustrated herein. Headings are provided for convenience only and are not to be construed to limit the invention in any way. Embodiments illustrated under any heading may be combined with embodiments illustrated under any other heading.

Referring to FIGS. 2-8, a preferred first embodiment of a lockable product package assembly 1 is disclosed. The package assembly 1 is intended to provide a product package that is, at the same time, both child-resistant and senior-citizen-friendly.

In FIGS. 2-8, the preferred first embodiment of the package assembly 1 comprises an outer sleeve 100 and a lockable inner tray 150 that slidably engages the outer sleeve 100.

Referring to FIG. 1, as will be discussed in further detail below, a first preferred embodiment of the outer sleeve 100 of the package assembly 1 may be formed from a single sleeve layout 16 of a flat material. In alternate embodiments, two or more separate layouts (not pictured) can be bent, folded, and connected to form the outer sleeve 100 of the package assembly 1. In the first preferred embodiment, the layout of the flat material 16, and accordingly the outer sleeve 100, is made from a durable paperboard or cardboard material. However, in alternate embodiments the layout 16 may also be made from plastic, Tyvek, or any other suitable durable material that can be bent or formed and will hold its bent or formed shape. In yet further alternate embodiments, the outer sleeve 100 may be formed by any number of known molding processes and any number of known materials that are capable of being molded.

Referring to FIG. 1, in the preferred first embodiment, the layout of the flat material 16 is cut to a predefined pattern or shape. The layout 16 includes a series of markings 18 at specific locations to aid in the folding of the layout 16 to form the assembled outer sleeve 100. Such markings 18 can include indentations or creases that are physically stamped, pressed, or molded into a surface of the layout 16, one or more lines or images drawn or stamped onto a surface of the layout 16, or any other similar type of marking or combination thereof, to indicate the folding or forming locations. The layout 16 includes a left major panel 20 having a semicircular cutout 22 disposed in a top edge 24 thereof, adjacent to which, the word "Pull" has been optionally marked. The left major panel 20 also includes a hole or opening 26 disposed in a lower portion thereof, adjacent to which, the word "Push" has optionally been marked. A first narrow side panel 28 joins the right side of the left major panel 20 to a middle major panel 30. The middle major panel 30 is joined at its top end to a top middle flap 34, and includes a circular cutout 32 disposed across both the middle major panel 30, and the top middle flap 34. The top middle flap 34 includes opposing curved top edges 36. As shown in FIG. 1, while the top edges 36 of the top middle flap 34 are curved, this is only an exemplification of the shape(s) of the top edge(s) 36, and it should be understood that many alternate top edge 36 shapes are considered within the scope of this disclosure. The middle major panel 30 is joined at its bottom end to a narrow bottom panel 38. The narrow bottom panel 38 is in turn joined at its bottom end to a sleeve closure flap 40. The sleeve closure flap 40 includes two longer tabs 42 extending downward from the left and right sides of a lower portion of the flap 40.

A second narrow side panel 44 joins the right side of the middle major panel 30 to the left side of a right major panel 46. The right major panel 46 is joined at its top end to a top right flap 48 and includes a circular cutout 50 disposed across both the right major panel 46, and the top right flap 48. The right major panel 46 has a lock opening 52 disposed at its lower half, which, when the sleeve 100 is assembled, is configured to engage with one or more locking portions of an inserted tray.

In a first preferred embodiment, to assemble the sleeve 100, the layout 16 is generally folded along the markings 18 to form the outer sleeve 100. To begin the sleeve 100 assembly process, the top middle flap 34 and the top right flap 48 are folded, in the same direction, along markings 18 and through the center of the circular cutouts 32 and 50, respectively. The flaps 34 and 48 are folded in a direction such that they will both be located inside of the final assembled sleeve 100. The face of the top middle flap 34 that has been folded over is secured, by glue or otherwise, to a complimentary face of the middle major panel 30. However, unlike the top middle flap 34, the top right flap 48 does not have its face secured to any other panel, by glue or otherwise. Rather, the top right flap 48 will remain free to flap/hinge about its folded edge within the final assembled outer sleeve 100. The folding-over of the top right flap 48 about the center of circular cutout 50 results in the formation of part of a front semicircular cutout 112, which is a feature of the fully assembled sleeve 100 (see FIGS. 2 and 4-8). Similarly, the folding-over of the top middle flap 34 about the center of circular cutout 32 results in the formation of a back semicircular cutout 114, which is also a part of the fully assembled sleeve 100.

Next, the right major panel 46 and second narrow side panel 44 are folded along their markings 18 such that the middle major panel 30 and the right major panel 46 are aligned with, and parallel to, one another. The left major panel 20 and first narrow side panel 28 are then similarly folded along their markings 18, such that the left major panel 20 (1) is parallel to and aligned with both the middle major panel 30 and right major panel 46, and (2) overlays the right major panel 46 on the outside of the sleeve 100. The left major panel 20 is then secured onto the aligned outer face (relative to the sleeve) of the right major panel 46 by glue or other means. The alignment and securing of the left major panel 20 onto the right major panel 46 also completes the formation of the front semicircular cutout 112 in the sleeve 100, as the semicircular cutout 22 in the left major panel 20 is also now aligned with, and secured to, the circular cutout 50 that was previously folded over with the top right flap 48.

The narrow bottom panel 38 and sleeve closure flap 40 are folded about their markings 18 such that the narrow bottom panel 38 forms a bottom wall 108 of the sleeve 100, and the sleeve closure flap 40 is parallel to and overlays onto a bottom portion of the left major panel 20, with the tabs 42 straddling the opening 26 in the left major panel 20. The sleeve closure flap 40 is secured to the outer face of the left major panel 20 by glue or other means. The position directions noted in this disclosure (i.e. left, right, top, bottom, upper and lower) are with respect to the drawing of FIG. 1 (or other drawings referenced herein) and do not limit the structure or orientation of the product packaging device. In alternate embodiments, the size, shape, and position of any openings, cutouts, or edges associated with the layout 16 may vary without departing from the scope and spirit of this disclosure. Furthermore, the order of assembly of the layout 16 may also vary without departing from the scope of this disclosure.

Figure 2:
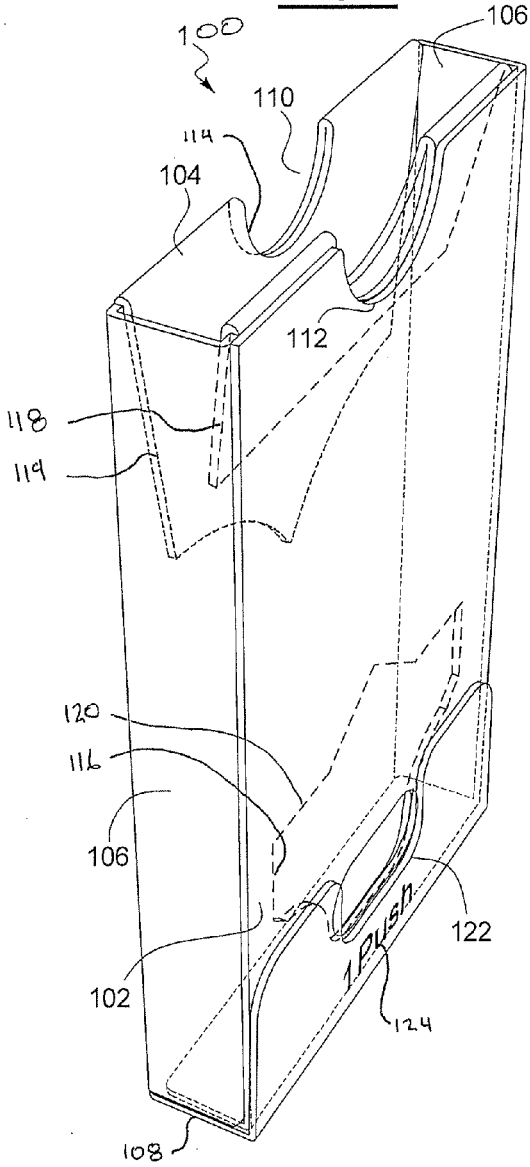
FIG. 2 is an isometric projection view of a first embodiment of an outer sleeve, assembled from the flat layout of FIG. 1, of a lockable package assembly disclosed herein, wherein certain interior features of the sleeve are shown in phantom line view.
Figures 4, 5:
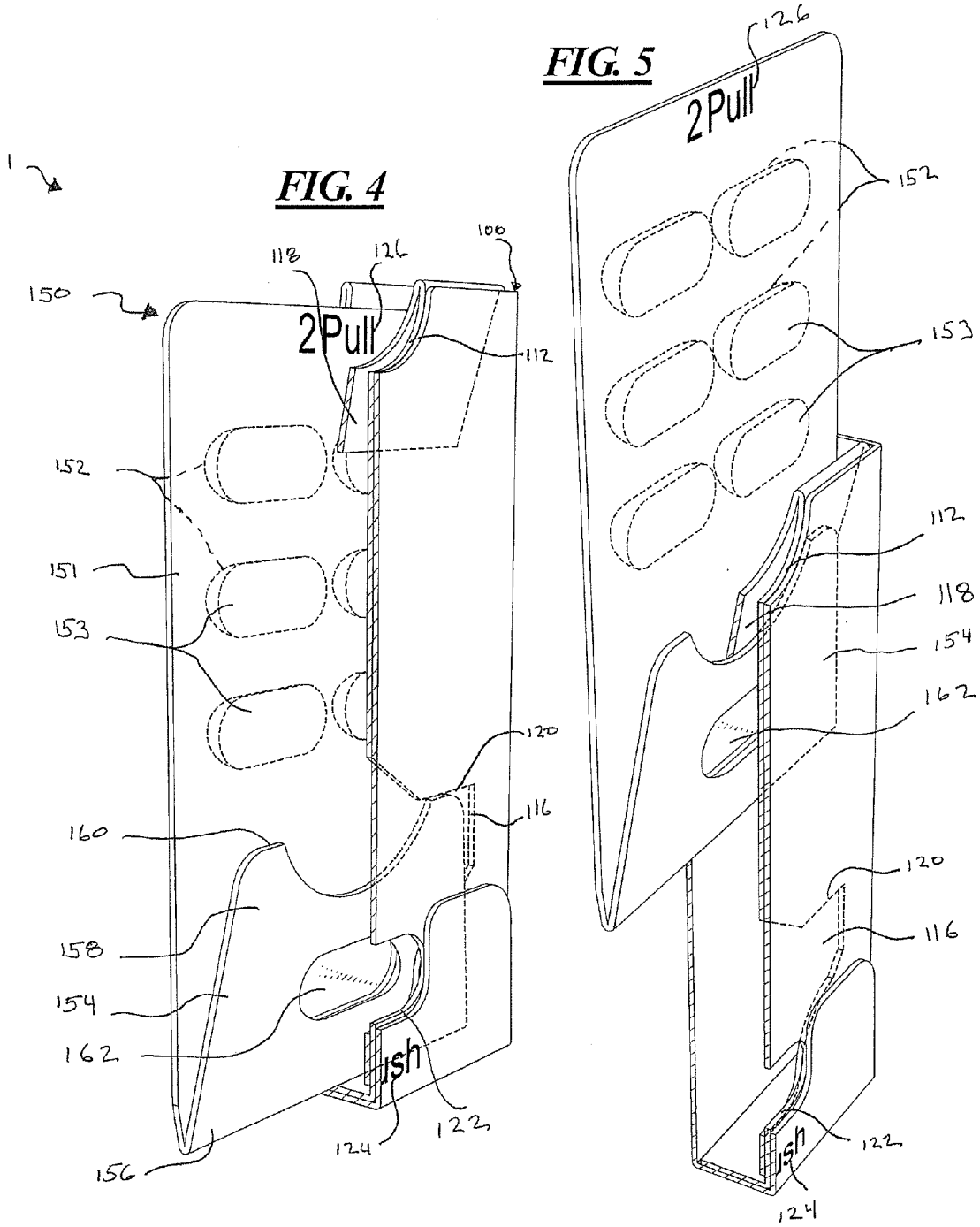
FIG. 4 is an isometric partial section view of a first embodiment of the lockable package assembly shown in a locked condition, the lockable package assembly including the outer sleeve of FIG. 2 (shown in section view) and the inner tray of FIG. 3 inserted therein.
FIG. 5 is an isometric partial section view of the lockable package assembly of FIG. 4 in which the inner tray is in an unlocked condition and has been moved to a fully extended, opened position in relation to the sleeve, and wherein full removal of the tray from within the outer sleeve is prevented by a sleeve-catch disposed on an interior surface of the outer sleeve.

Referring to FIGS. 2 and 4-5, in a first preferred embodiment, the sleeve 100 has been formed from the layout 16 of FIG. 1. Once assembled, the outer sleeve 100 is generally in the shape of a substantially closed rectangular box having: a front wall 102 (formed by the secured left and right major panels 20 and 46 of the layout 16 of FIG. 1); a back wall 104 (formed by the middle major panel 30 of the layout 16 of FIG. 1); side walls 106 (formed by the first and second narrow panels 28 and 44 of the layout 16 of FIG. 1) that join the front and back walls 102 and 104; a bottom wall 108 (formed by the narrow bottom panel 38 of the layout 16 of FIG. 1); and an open top end 110 into which an inner tray 150 may be slidably inserted. As disclosed above, the sleeve 100 also includes a front semicircular cutout 112 disposed in a top edge of the front wall 102 and a back semicircular cutout 114 disposed in a top edge of the back wall 104, both of which are adjacent to the open top end 110. Furthermore, when the layout 16 is formed into the outer sleeve 100, the folded-over top right flap 50 becomes a sleeve-catch 118. The sleeve 100 further includes a release-button opening 122 disposed in a lower portion of the front wall 100. In a preferred embodiment, the release button opening 122 in the sleeve 100 is formed by the overlaying of the opening 26 in the left major panel 20 onto the lock opening 52 in the right major panel 46 of the layout 16. In the sleeve embodiment depicted in FIG. 2, unlike as shown on the layout of FIG. 1, the marking "Push" has been relocated to the sleeve closure flap 40 on the layout 16 so that it will appear below the release button opening 122 once the sleeve 100 has been assembled. In addition, the "marking "Pull" has been removed from the sleeve 100 and relocated to the inner tray 150 (see FIGS. 4-5). Still further alternate positioning of these markings is contemplated by the present disclosure.

Figure 3:
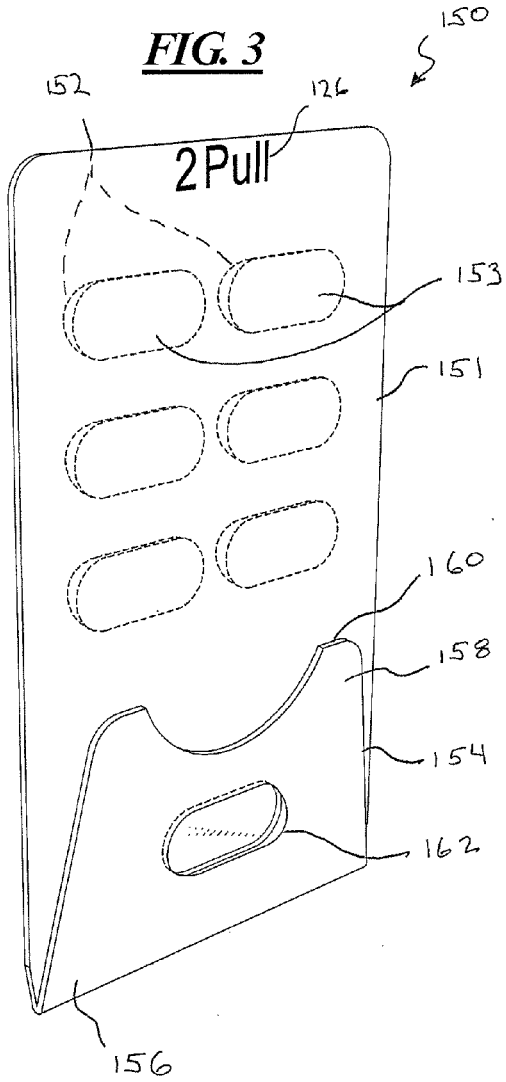
FIG. 3 is an isometric projection view of an embodiment of an assembled inner tray of a lockable package assembly disclosed herein, the inner tray containing a protruding release button and blisters for holding pills or other products.

Referring to FIGS. 4-5, various features of the interior structure of the sleeve 100, as well as the tray 150 within the sleeve 100, are shown in broken outline phantom view. Referring to FIG. 3, the sleeve 100 further includes a tray locking recess 116 disposed in an interior surface of the front wall 100 of the sleeve 100, the recess 116 having a locking edge 120. The tray locking recess 116 is formed from the layout 16 when the lock opening 52 in the right major panel 46 is covered, from the outside, by the left major panel 20. Any openings, recesses, and/or cutouts disclosed, may have alternate shapes and be found at different locations in, on, or within the outer sleeve 100 without departing from the scope of the disclosure herein.

Figure 6:
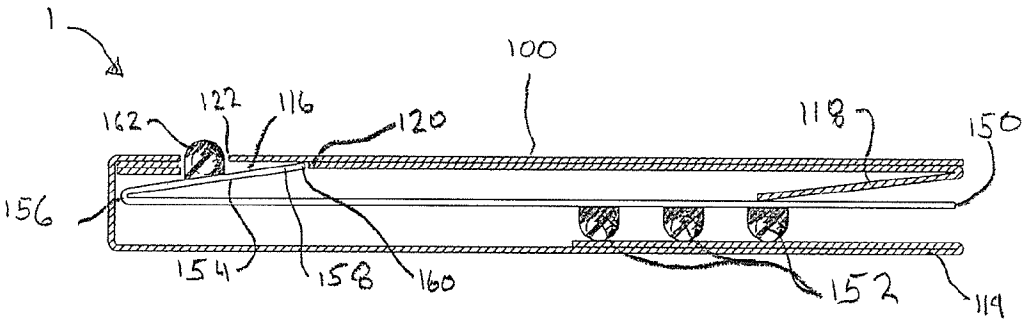
FIG. 6 is a side cross-sectional view of the assembled sleeve and tray of FIG. 4 in the closed position, showing a protruding release button on the tray engaged with the release-button opening in the sleeve, as well as the locking portion of the tray engaged within the recess in the sleeve such that the tray is in the locked position.
Figure 7:
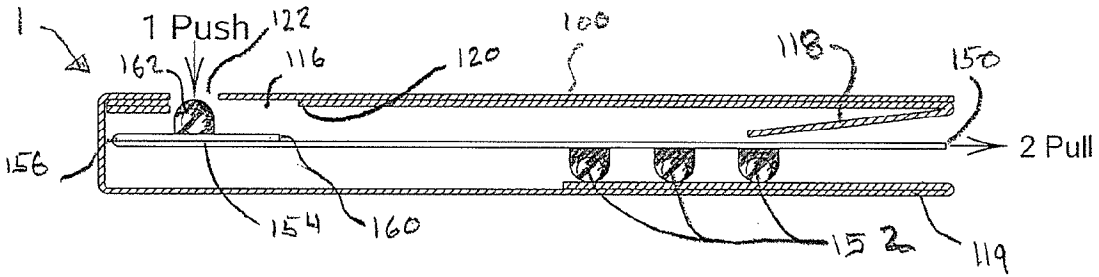
FIG. 7 is a side cross-sectional view of the assembled sleeve and tray of FIG. 4 in the closed position showing the release button after it has been depressed by a user, which causes the release button and locking portions of the tray to disengage from the release-button opening and locking recess in the sleeve respectively, so that the tray is in the unlock condition.
Figure 8:
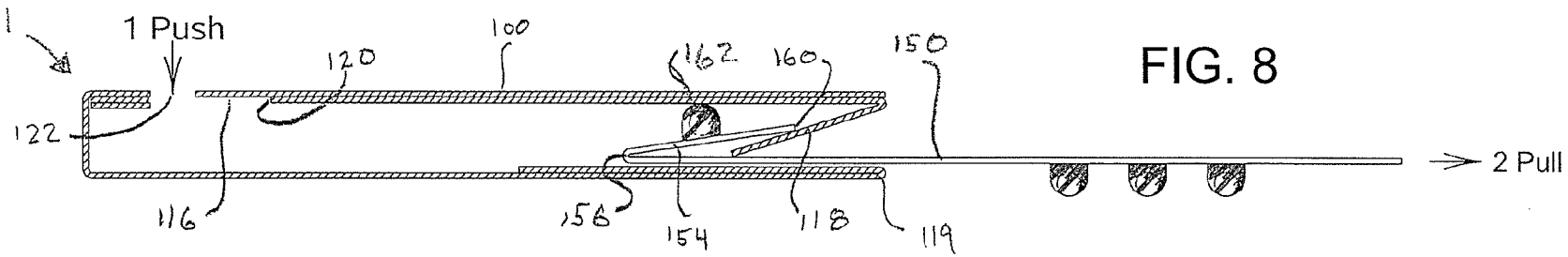
FIG. 8 is a side cross-sectional view of the assembled sleeve and tray of FIG. 4 showing the tray in the fully opened position and showing a sleeve-catch within the sleeve that prevents complete removal of the tray.

Referring to FIGS. 3-8, in a first preferred embodiment, the tray 150 is a blister-pack tray that comprises a product portion 151 including a plurality of individual blisters 152 (shown in FIGS. 6-8). The blisters 152 of the illustrated embodiment are raised enclosures of clear, translucent, or opaque material, such as plastic, within which pills, tablets, capsules, gelcaps, other medicaments, or other products are enclosed. The blisters 152 are enclosed in such a manner that the application of pressure on the blister 152 ruptures a membrane, or other similar backing 153, disposed opposite the blister 152, and releases the pill or other product.

Referring to FIGS. 2-8 and 10-16, the tray 150 is preferably made from a single continuous layer of tray material. In a first preferred embodiment, the tray 150 is a single continuous layer of tray material in which the blisters 152 are integrally formed. For example, the tray 150 of the first preferred embodiment may be made from a plastic or other polymer sheet or card, such as PVC, wherein the blisters 152 are created in the tray 150 by vacuum forming, molding, thermoforming, or other similar manufacturing processes. However, in alternate embodiments the tray 150 may also be made from other plastics, polymers, Tyvek, paperboard, or any other suitable durable material, or any combination thereof. Products, such as pills, capsules, other medicaments, or other products, are placed inside the blisters and a membrane or other backing seals the product inside the blister.

Figure 17:
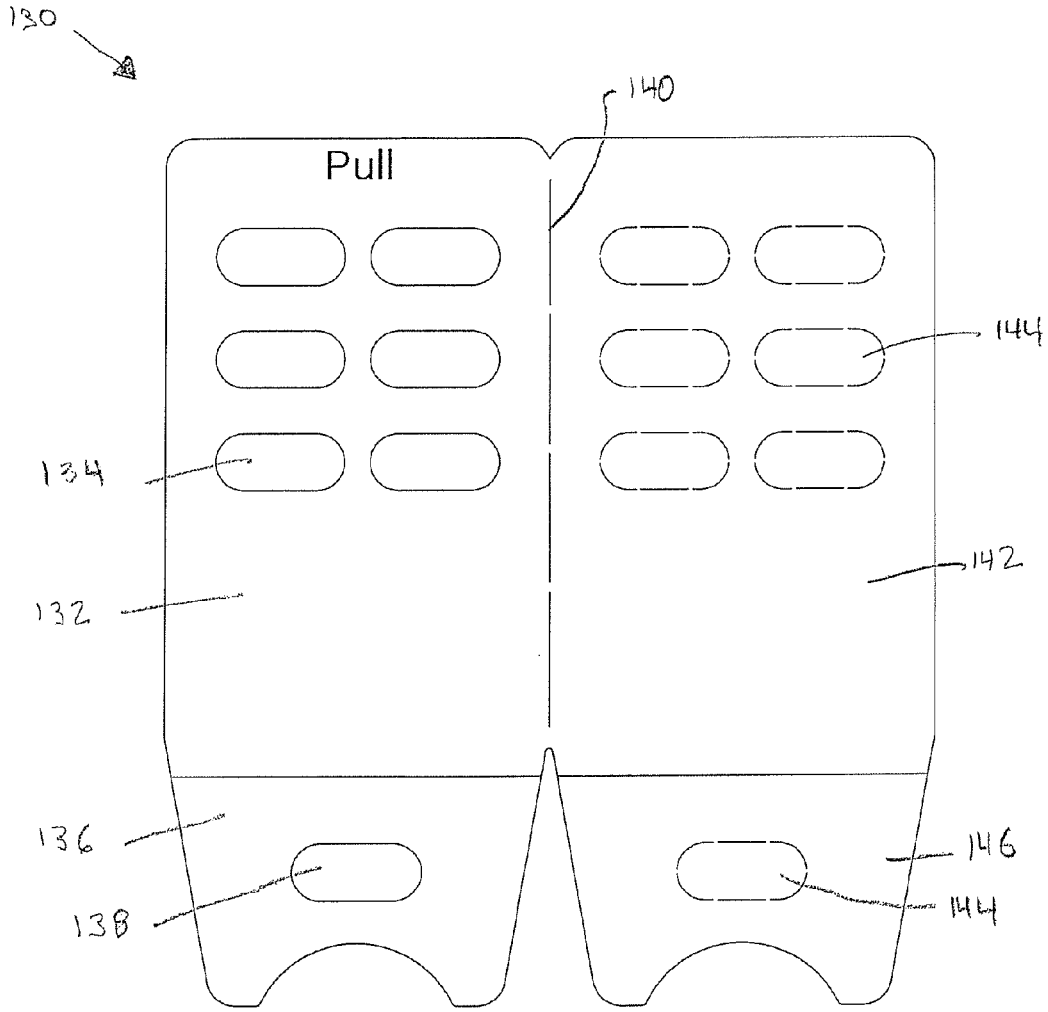
FIG. 17 is a plan view of an embodiment of a flat tray layout used to form a double-layered tray of the product package assembly of FIGS. 4 and 12, and showing the location of a release button.

Referring to FIG. 17, a second preferred embodiment of the tray 150 may be formed from a tray layout 130 of flat material. In alternate embodiments, two or more separate layouts (not pictured) can be bent, folded, or connected to form the inner tray 150 of the package assembly 1. Unlike the tray of the first preferred embodiment, the tray of the second preferred embodiment can be made from a plurality of layers, one example of which is a double-layered tray formed by the layout in FIG. 17. In the second preferred embodiment, the tray layout 130, and accordingly the tray 150, is made from a durable paperboard or cardboard material. However, in alternate embodiments the tray layout 130 may also be made from plastic, Tyvek, foil, paperboard, any other suitable durable material, or any combination thereof. In yet further alternate embodiments, the tray 150 may be formed by any number of known molding, vacuum forming, or other material forming processes, and formed from any number of known materials that are capable of being molded or formed.

Referring further to FIG. 17, in the second preferred embodiment, the tray layout 130 has a left tray panel 132 within which are disposed a plurality of blister-openings 134. The left tray panel 132 is attached, at its bottom end, to a left tray flap 136, in which a release-button-blister opening 138 is disposed. The left tray panel 132 is attached on its right side, by a perforated edge 140, to a right tray panel 142, in which is disposed a plurality of perforated blister-backings 144 in the shape of the blister openings 134. The right tray panel 142 is attached, at its bottom end, to a right tray flap 146, in which may be disposed a complimentary perforated blister-backing 144 in the shape of the release-button-blister opening 138. The tray 150 is assembled by placing blisters 152 (either empty or pre-loaded with products sealed within) into the plurality of blister openings 134 and 138 in the left tray panel 132 and left tray flap 136. If the blisters 152 are empty, products are loaded into the blisters 152 located in the left tray panel 132, and the blisters 152 may optionally be sealed closed with a membrane or other means. The right tray panel 142 and right tray flap 146 are then folded over about the perforated edge 140 and secured to the left tray panel 132 and left tray flap 136, sealing the blisters 152 and products there between. In this manner, the perforated blister-backings 144 are overlaid onto, and aligned with, both the blister openings 134 and the release-button-blister opening 138.

Referring to FIG. 3, the product portion 151 of inner tray 150 is generally in the shape of a flat rectangular card that is inserted into the open top end 110 of the sleeve 100, and slidably engages with the interior of the sleeve 100. However, the above disclosure should not be read to limit the shape of the either the inner tray 150 or the product portion 151 of the inner tray 150 to only being rectangular in shape or a flat card. Rather, both the tray 150 and/or product portion 151 of the tray 150 can be of any shape that works with and compliments the shape of the outer sleeve 100 and still provides the functionality disclosed herein. For example, in alternate embodiments, the tray and/or product portion can be a flat circular card, a rectangular or other shaped box that can be inserted into the sleeve 100, or other such alternate shapes, without departing from the scope of this disclosure. The tray may be a single layer tray or multi-layered tray. The product portion 151 of the tray 150 may contain unit dose packaging and products, liquid or dry fill packaging, in all types of containers including blisters, bottles, pouches, syringes, vials, and sachets. Alternatively, the product portion 151 of the tray 150 may not contain any physical products; rather it may contain images, text, or other graphical information or content.

Referring to FIGS. 3-7 and 17, in addition to having a product carrying portion 151 and product blisters 152, the assembled tray 150 further includes a locking portion 154, which in the second preferred embodiment is formed from the layout of FIG. 17 by the securing of the right tray flap 142 to the left tray flap 136 of the tray layout 130. The locking portion 154 is thus attached to the tray 150 at a bottom end of the tray 150. In a first preferred embodiment, the locking portion 154 of the tray 150 is a flap of tray material that has been folded back on itself and acts as a flat cantilevered spring, such that, when a force is applied to the locking portion 154 in the direction of the fold, the locking portion 154 applies an equal force in the opposite direction (i.e. generally away from the direction of the fold). However, the disclosure of the first preferred embodiment of the locking portion 154 should not be read to limit the shape of the locking portion to that of a folded flap. Rather it should be understood that in alternate embodiments of the tray 150, the locking portion 154 may be of other shapes and configurations, such a leaf spring for example, and still be within the scope of this disclosure. In the first preferred embodiment, the flap-shaped locking portion 154 includes a fixed end 156 that is connected as a living hinge to a lower end of the tray 150, a free end 158, a lock edge 160 disposed on the free end 158, and a release button 162 protruding from a surface of the flap-shaped locking portion 154. As disclosed above, the release button 162 may be formed during the same process and of the same material as the product enclosing blisters 152 on the tray 150, thus simplifying manufacture. However, it is to be understood that other protrusions or raised release button forming and/or applying techniques and materials are also possible and within the scope of this disclosure.

Referring to FIGS. 4 and 6, in the first and second preferred embodiments, to load the blister pack tray 150 into the sleeve 100, the flap-shaped locking portion 154 of the tray 150 is folded toward the tray 150 with the release button 162 facing outward and away from the tray 150. This generally will place the release button 162 and the product blisters 152 on opposite sides of the tray 150. The end of the tray 150 containing the locking portion 154 is then slidably inserted into the open top end 110 of the sleeve 100 such that the release button 162 faces the front wall 102 of the sleeve 100, where the release-button opening 122 is also located. Furthermore, when inserting the tray 150 into the open top end 110 of the sleeve 100 in the manner disclosed above, the free end 158 of the locking portion 154 of the tray 150 slides over and past the free end of the flap-shaped sleeve-catch 118 of the sleeve 100. Continuing the sliding of the tray 150 into the sleeve 100 will cause the side of the tray 100 opposite the product blisters 152 (i.e. the blister backing side of the tray) to slide against the free end of the sleeve-catch 118. When the tray 150 has been fully inserted into the sleeve 100 and is in a locked condition, at least the lock edge 160 of the locking portion 154 of the tray 150 engages with, and resides in, the locking recess 116 disposed in the inner surface of the sleeve 100, so as to prevent withdrawal of the tray 150 from the sleeve 100. More specifically, while in the locked condition, the tray 150 is prevented from being removed from the sleeve 100 by the interference engagement between the lock edge 160 of the inner tray 150 and the locking edge 120 on the recess 116 of the sleeve 100. Once the tray 150 is inserted to a fully seated and locked condition, the blisters 152 and the associated products contained therein are enclosed within the sleeve 100 and inaccessible to a user. In addition, once fully inserted to an inaccessible and locked condition within the sleeve 100, the release button 162 on the tray 150 becomes visible and accessible through the sleeve's release-button opening 122.

In a first preferred embodiment, in addition to the tray's lock edge 160 engaging with the sleeve's locking edge 120, the release button 162 also protrudes through the release-button opening 122 in the lower portion of the sleeve 100, thus causing an interference with the release-button opening 122, and partially serving as a redundant locking feature further preventing withdrawal of the tray 150 from the sleeve 100. In alternate embodiments, the release button 162 may only partially protrude, or not protrude at all, through the release-button opening 122. In such alternate embodiments, the release button opening 122 primarily serves to provide easy access to the release-button 162 to allow a user to easily disengage the lock edge 160 on the tray from the locking edge 120 on the sleeve 100. In still further alternate embodiments, the release button 162 protruding through the release button opening 122 causes an interference between the tray 150 and sleeve 100 when attempting to slide the tray 150 from within the sleeve 100, and may be the sole locking feature used to prevent a sliding movement between the tray 150 and the sleeve 100.

With the tray 150 fully inserted to an inaccessible and locked position in the sleeve 100, the front and back semicircular cutouts 112 and 114 in the sleeve 100 leave a top portion of the tray 150 exposed. The cutouts 112 and 114 allow a user to grip the exposed top portion of the tray 150 using a thumb and finger. The previously disclosed markings of "Push" 124 adjacent the release-button opening 122 and "Pull" 126 adjacent the cutout 112 at the open top end 110 of the sleeve 100 provide indicia to a user of the lockable package assembly 1 that the user must "Push" on the release button 162 and "Pull" on the exposed top portion of the tray 150 in order to slidably extend the tray 150 from the inaccessible locked position within the sleeve 100, to an accessible unlocked position outside of the sleeve 100, thus opening the package assembly 1.

Referring to FIGS. 2-8, while previously disclosed embodiments have included "Push" and "Pull" markings 124 and 126 disposed at various locations on the sleeve 100, in alternate embodiments, the package assembly 1 may include other indicia or markings disposed at other locations on the package assembly 1 to indicate to a user the specific manner in which the sleeve 100, tray 150, or other aspect of the package 1 must be manipulated to open the package assembly 1. For example, in additional alternate embodiments, the "Pull" marking 126 or other indicia may be located on the portion of the tray 150 appearing through one or more of the semicircular cutouts 112 and 114 in the sleeve 100 (see FIGS. 2-8), while the "Push" marking 124 may be located on, or inside of, the release button 162 of the tray 150. In yet further additional embodiments, the manipulation indicia may be located on just the tray 150, just the sleeve 100, or any combination of the tray 150 and/or sleeve 100. It is also foreseen that no indicia as to manipulation of the package 1 may be provided on the package 1 itself, and that instructions on the operation of the package 1 may instead be provided to the user in a manner separate from the package 1.

Referring to FIGS. 4-8, to extend the tray 150 from the sleeve 100 and thus open the package assembly 1 of a first preferred embodiment, a user first depresses the release button 162 through the release-button opening 122 adjacent the indicia marked "Push" 124 (see FIGS. 6 and 7), thereby moving the locking portion 154 of the tray 150 out of engagement from both the recess 116 and the locking edge of the sleeve 100. More specifically, in a first preferred embodiment, depressing the release button 162 causes the locking portion 154 of the tray 150 to hinge about its fixed end 156 and rotate the lock edge 160 of the tray's locking portion 154 away from the locking edge 120 created by the recess 116 in the sleeve 100 (see FIGS. 6 and 7). Furthermore, depressing the release button 162 also causes the release button 162 itself to unseat from within the release-button opening 122 in the sleeve 100, in those embodiments in which the release button 162 protrudes through the release-button opening 122 when in a locked condition. In any of the aforementioned and contemplated embodiments, the force required to disengage the locking portion 154 from the lock recess 116 in the sleeve 100 is low as compared to any prior art child-resistant packages, thus making the embodiments herein senior-friendly as well as child-resistant.

Next referring to FIGS. 4, 5, and 7-8, with the release button 162 depressed, the user grips the top edge of the tray 150 at the area exposed by the semicircular cutouts 112 and 114 at the indicia marked "Pull" 126 and pulls on the tray 150, thus beginning to slide the tray 150 out of the sleeve 100 to expose the product blisters 152. The tray 150, and in particular the blisters 152 containing the products, rests on a double wall-thickness 119 of the sleeve material where the top middle flap 34 of the layout 16 has been folded over and secured to the middle major panel 30. The double thickness of the sleeve material adds strength to the sleeve 100 and allows the blisters 152 to slide more easily as the tray 150 is moved in and out of the sleeve 100. The curved top edges 36 of the top middle flap 34 permit the blisters 152 to slide over the secured top middle flap 34 without catching or binding up. As disclosed previously, various configurations or shapes of the top edges 36 of the top middle flap 34 may be provided in alternate embodiments.

Referring to FIGS. 5 and 8, sliding the tray 150 from within the sleeve 100 exposes the first and subsequent rows of blisters 152. The rows of products contained within the blisters 152 on the tray 150 extend out of the sleeve and become accessible by the user. In FIG. 5, the oval-shaped release button 162 may be seen on the locking portion 154 of the tray 150 within the sleeve 100. The release button 162 has been moved out of the locked position, which would otherwise allow the lock edge 162 of the tray 150 to re-engage the locking edge 120 of the sleeve 100.

In FIGS. 5 and 8, the user has further pulled the tray 150 to a fully extended, open, and accessible position from within the sleeve 100. In such a fully extended position, all of the products contained within the blisters 152 on the tray 150 are accessible to the user for removal, such as by rupturing a membrane that seals the blister 152 closed. However, the configuration of the mated tray and sleeve is such that the tray 150 cannot easily be pulled completely out of the sleeve 100 in the unlocked condition. To prevent complete withdrawal of the tray 150 from the sleeve 100, the tray's locking portion 154, located in FIG. 8 at the left end of the tray 150, catches the sleeve-catch 118, located in FIG. 8 at the right end of the sleeve 100, in a hooking-manner to prevent the tray 150 from being completely removed from within the sleeve 100. Although the tray 150 cannot be removed completely from the sleeve 100, all of the blisters 152 on the tray are outside of the sleeve 100 and accessible to the user. Even with the tray 150 at this fully extended position, the user needs only to slide the tray 150 completely back into the sleeve 100 to place it back into the locked position of FIGS. 4, and 6. In the locked position, the locking flap 154 of the tray 150 re-engages the locking recess 116 inside the sleeve 100, causing the lock edge 160 on the tray 150 to re-engage the locking edge 120 in the sleeve's recess 116, and causing the release button 162 to be in a position such that it is accessible through, and in some embodiments will project through, the release-button opening 122 at the top left of the tray in FIG. 6, relative to the drawing.

As is apparent from the drawings, in a preferred first embodiment, the release button 162 is of generally the same size and shape as the blisters 152 for holding the products, which may be pills, capsules or the like. It is simple and inexpensive to form an extra blister, of the same size, shape, and material as the other blisters 152 on the tray 150, to provide the release button 162. It is foreseen that the release button blister 162 may be formed to be resistant to deformation, such as by being formed to have a thicker wall than the deformable blisters 152 containing the product or by being of a shape to resist deformation, such as by including ridges or corrugations in the walls. No product is enclosed within the release button 162, although it is permissible in some instances a product may be provided in the release button 162. Of course, it is possible that the release button 162 may be of other sizes, shapes or configurations, or even of other materials.

Figure 9:
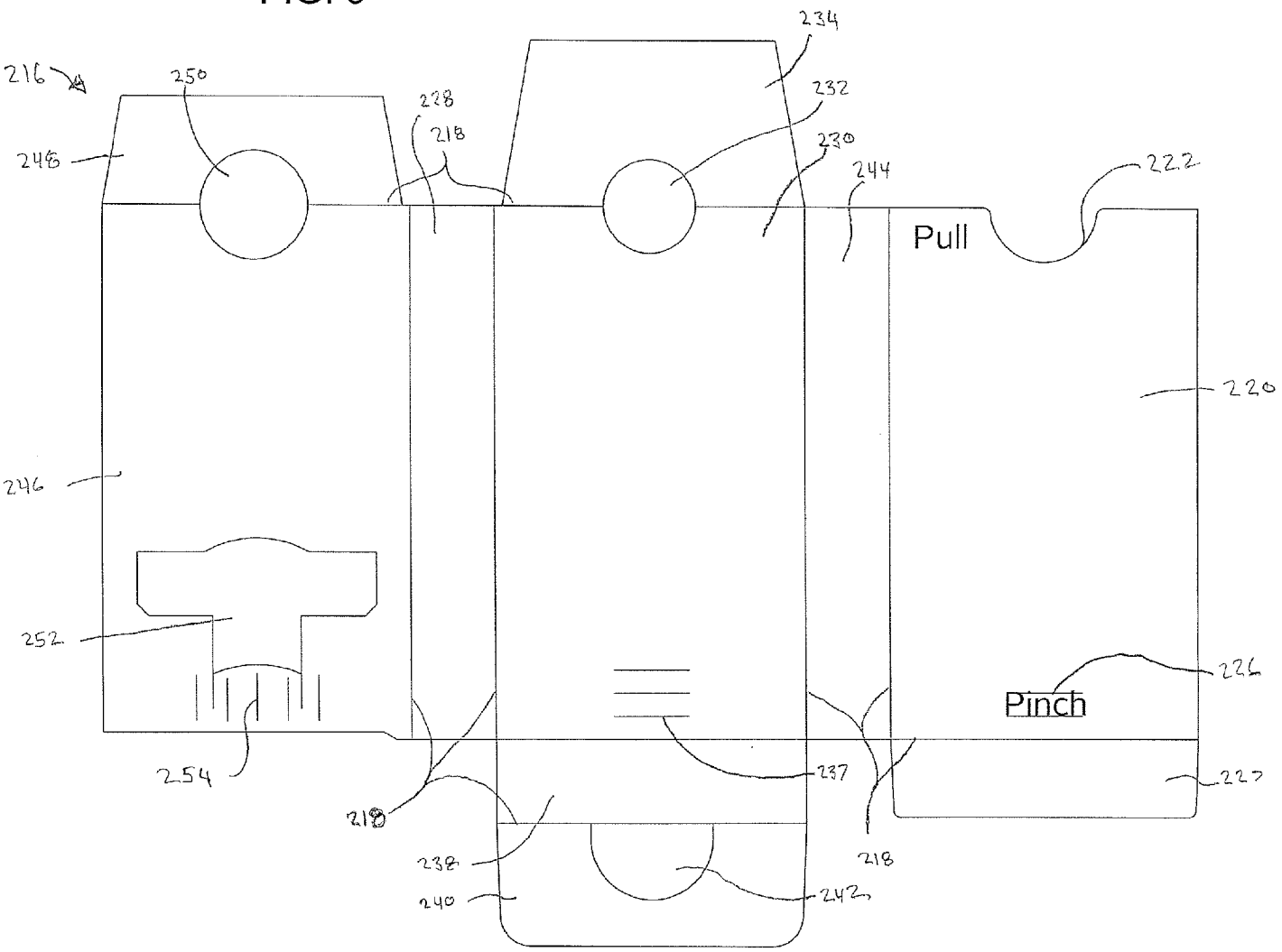
FIG. 9 is a plan view, showing cut and fold locations, of a flat sleeve layout that can be folded to form an outer sleeve with a pinch-to-open operation, according to a second embodiment of a lockable package assembly.

Referring to FIG. 9, a second preferred embodiment of a flat layout 216, used to form a second preferred embodiment of a sleeve 350 of a lockable product package assembly 201, is disclosed. The layout 216 includes a plurality of markings 218 disposed at specific locations to aid in the folding of the layout 216 and forming of the assembled outer sleeve 300. In this embodiment, a left major panel 246 forms the inside surface of a front wall of sleeve 300 in the assembled product package assembly 201, and is joined at its top end to a top left flap 248. The left major panel 246 further includes a lock opening 252 disposed at a lower end thereof, as well as a circular cutout 250 disposed across both the left major panel 246 and the top left flap 248. A first narrow side panel 228 joins the left major panel 246 to a middle major panel 230. The middle major panel 230 is attached at a top end thereof to a top middle flap 234, and includes a circular cutout 232 disposed across both the middle major panel 230, and the top middle flap 234. The middle major panel 230 is joined at its bottom end to a narrow bottom panel 238. The narrow bottom panel 238 is in turn joined at its bottom end to a sleeve closure flap 240. The sleeve closure flap 240 includes a semicircular cutout 242 disposed at a top end thereof, adjacent the narrow bottom panel 238. A second narrow side panel 244 joins the middle major panel 230 to a right major panel 220 having a semicircular cutout 222 disposed in a top edge 224 thereof, adjacent to which, the word "Pull," or some other indicia, has optionally been marked. In addition, the right major panel 220 is attached at its bottom end to a bottom right flap 227. The bottom portion of the right major panel includes a plurality of horizontal (with respect to the drawings) slits 226, adjacent to which the word "Pinch," or some other indicia, has been optionally marked. In alternate embodiments, instead of the slits 226, the material may only be scored as indicated. Vertical slits 254 or scorings are provided in a lower portion of the left major panel 246 at a corresponding location, such that the slits or scorings in the right major panel 220 will overlap the slits or scorings in the left major panel 246 when the sleeve 300 is assembled from the layout 216. Furthermore, horizontal slits 237 or scorings are also located in a lower portion of the middle major panel 230 in a further corresponding location, such that the slits 237 or scorings in the middle major panel 230 will be opposite the slits or scorings of the overlapped left and right major panels when the sleeve 300 is assembled. The slits or scored portions 226, 237, and 254 weaken the material to permit compressing of that portion of the sleeve 300 by a user squeezing the sleeve 300 in the area of the slits or scorings 226, 237, and 254. The slits or scorings 226, 237, and 254 may be oriented or positioned other than as shown, all of which fall within the scope of the present disclosure.

Referring to FIG. 10, in the second preferred embodiment, to assemble the sleeve 300, the layout 216 is generally folded along the markings 218 to form the outer sleeve 300. As in the previous embodiment, the top middle flap 234 and the top left flap 248 are folded in a direction such that they will both be located inside of the final assembled sleeve 300. The face of the top middle flap 234 is secured, by glue or otherwise, to a complimentary face of the middle major panel 230. However, the top left flap 248 does not have its face secured to any other panel. Rather, the top left flap 248 will remain free to flap/hinge about its folded edge within the final assembled outer sleeve 300. Folding over the flaps 248 and 234 respectively creates the front and back semicircular cutouts 312 and 314 in the assembled sleeve 300. The remainder of the folding of the layout 216 to form the sleeve 300 is similar to the first preferred embodiment disclosed above, with one primary exception; the left major panel 246 is first folded such that it is parallel to and aligned with the middle major panel 230, and the right major panel 220 is then folded so that it overlays, and is secured to, the left major panel 246. In FIG. 10, the sleeve 300 is shown fully assembled and ready to accept a tray 350.

Referring to FIGS. 10 and 11, several structures of the inside of the sleeve 300 (see FIG. 10) as well as the hidden features of the tray 350 (see FIG. 11) are shown in phantom, broken lines. Referring further to both FIGS. 12 and 14, the tray 350 is fully seated in the sleeve 300 and in a locked condition with the locking portion 354 seated in the recess 316 of the sleeve 300. More specifically, as previously disclosed, while in the locked condition, the tray 350 is prevented from being removed from the sleeve 300 by at least the interference engagement between the lock edge 360 of the inner tray 350 and the locking edge 320 on the recess 316 of the sleeve 300. In this embodiment, a release button 362 on the locking portion 354 of the tray 350 rests against the inside surface of the front wall 302 of the sleeve 300 (see FIG. 14), at a package pinch location where the word "Pinch" 324 or other indicia is marked on the outside wall of the sleeve 300. In this second preferred embodiment, the location marked "Pinch" 324 further coincides with a plurality of front slits 322 or scored positions that are disposed in a lower portion of the front wall 302 of the sleeve 300. These slits 322 were created by the overlapping of the slits 254 and 226 on the left major panel 246 and right major panel 220 of the layout 216, respectively. The sleeve also includes a plurality of back slits 323 (not shown in FIG. 11) disposed on a back wall 304 of the sleeve 300, which are the same slits 237 disposed in the middle major panel 230 of the layout 216.

Referring to FIGS. 12, 13, 15, and 16, to open the package assembly 201, a user pinches the sleeve 300 by exerting a force on the front and back walls 302 and 304 of the sleeve 300 at the location of the slits 322 and 323 marked by the word "Pinch" 324 or other indicia. Placing a thumb on the front slits 322, a finger on the back slits 323, and pinching them together deforms the front 302 and back walls 304 of the sleeve 300 at the location adjacent to the release button 362 and causes an interior surface of the front wall 302 to depress the release button 362 on the locking portion 354 of the tray 350. This in turn causes the locking portion 354 of the tray 350 to rotate out of engagement from the recess 316 in the sleeve 300, and more specifically, causes the lock edge 360 of the tray 350 to disengage from the locking edge 320 of the sleeve 300, so as to permit sliding movement of the tray 350 relative to the sleeve 300. The deformation of the sleeve 300 is made easier for the user by the specific arrangement of the slits 322 and 323 or scored portions. Other means for permitting deformation of the sleeve 300 at the location of the release button 362 are possible, such as a flexible membrane over the release button 362, a thin covering over the release button 362, or other deformable means.

Figure 12:
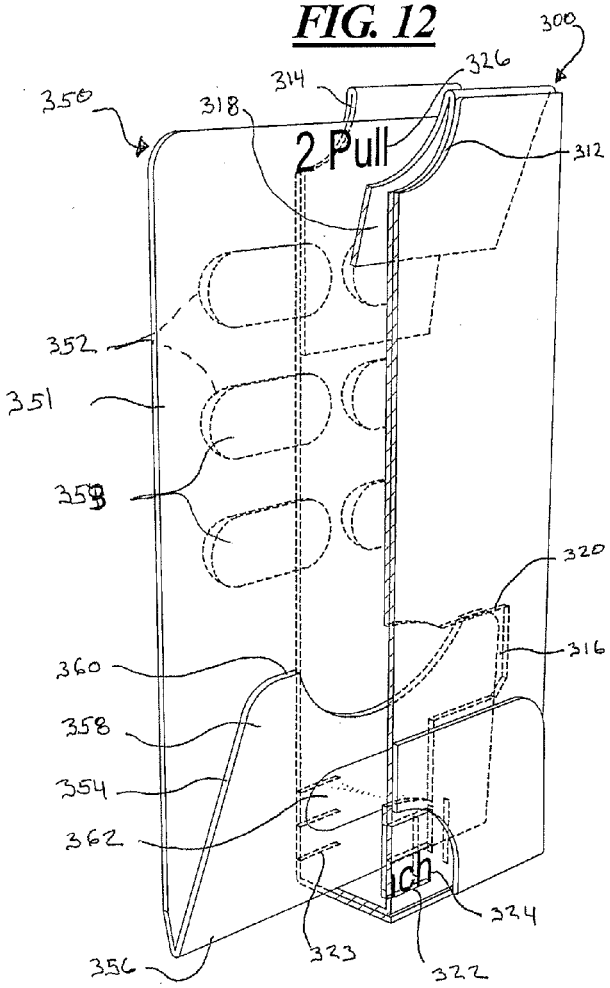
FIG. 12 is an isometric partial section view of a second embodiment of the lockable package assembly shown in a locked condition, the lockable package assembly including the outer sleeve of FIG. 10 (shown in section view) and the inner tray of FIG. 11 inserted therein.
Figure 13:
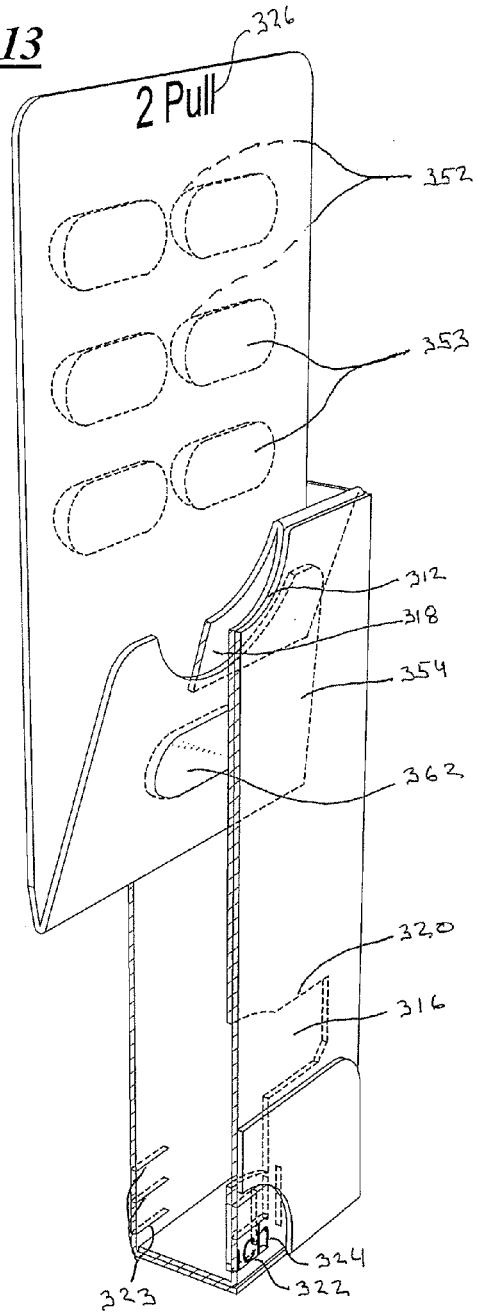
FIG. 13 is an isometric partial section view of the lockable package assembly of FIG. 12 in which the inner tray is in an unlocked condition and has been moved to a fully extended, opened position in relation to the sleeve, and wherein full removal of the tray from within the outer sleeve is prevented by a sleeve-catch disposed on an interior surface of the outer sleeve.
Figures 14, 15, 16:
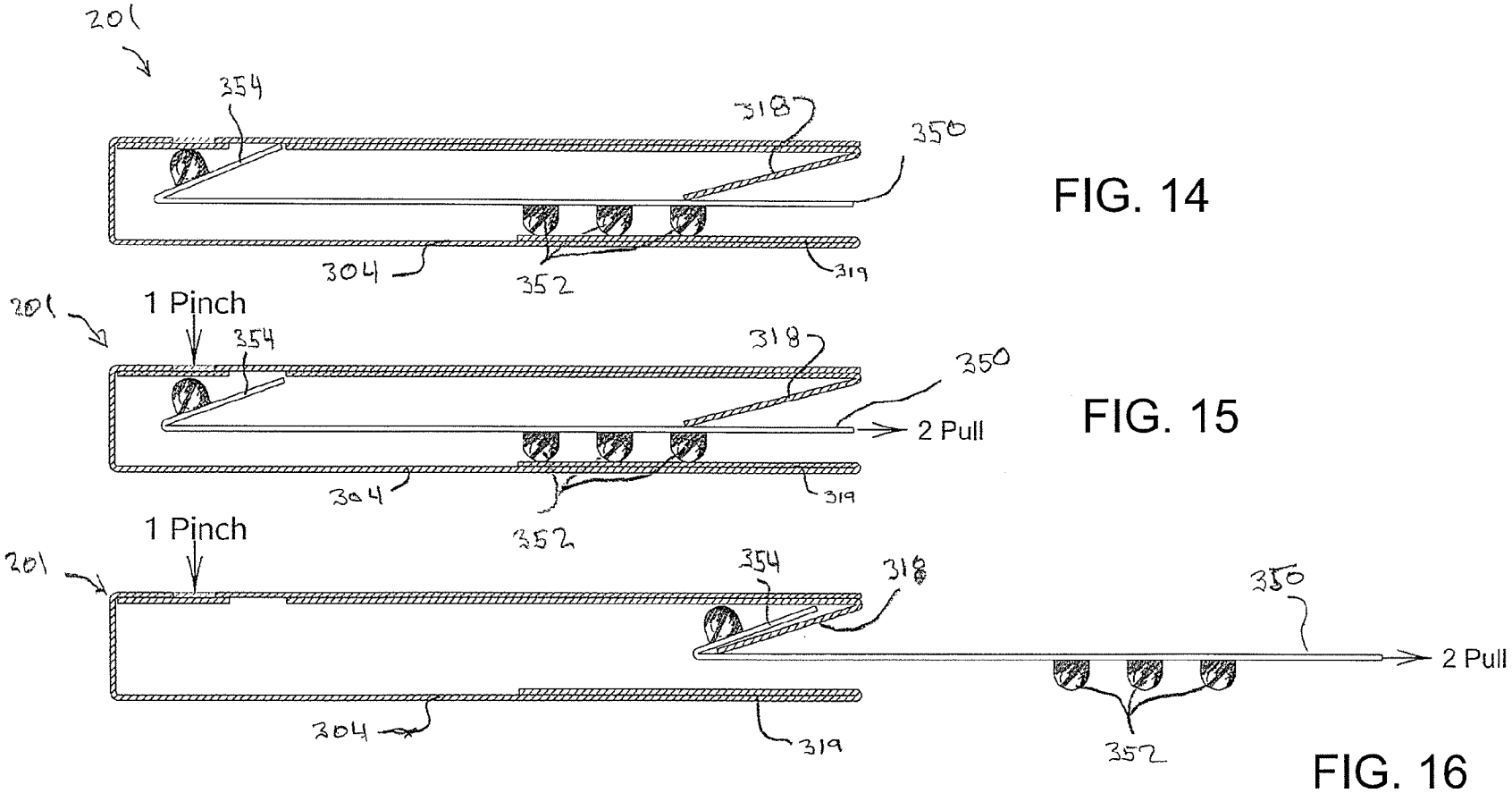
FIG. 14 is a side cross-sectional view of the assembled sleeve and tray of FIG. 12 in the closed position, showing a protruding release button on the tray resting against an inner surface of the sleeve, as well as the locking portion of the tray engaged within the recess in the sleeve such the tray is in the lock condition.
FIG. 15 is a side cross-sectional view of the assembled sleeve and tray of FIG. 12 in the closed position showing the release button being depressed by a pinching motion on the outside of the sleeve, which causes the locking portion of the tray to become disengaged from the locking recess in the sleeve so that the tray is in the unlocked condition.
FIG. 16 is a side cross-sectional view of the assembled sleeve and tray of FIG. 12 showing the tray in a fully opened position and showing a sleeve-catch within the sleeve that prevents complete removal of the tray.

Referring to FIGS. 12 and 15, once the release button 362 has been depressed, the tray 350 may be removed from the sleeve 300 by a user pulling on the top edge of the tray 350 at an area exposed by the semicircular cutouts 312 and 314 adjacent the indicia marked "Pull" 326. Referring to FIGS. 13 and 16, the product package assembly 201 is shown with the tray 350 in a fully extended position relative to the sleeve 300, such that the tray 350 cannot be further removed from the sleeve 300. As in the previous embodiment, the tray's locking portion 354, shown in FIGS. 14-16 at the left end of the tray 350, catches the sleeve-catch 318, shown in FIGS. 14-16 at the right end of the sleeve 300, to prevent the tray 350 from being completely removed from within the sleeve 300.

Referring to FIG. 15, when the tray is removed from the sleeve 300, the product-enclosing blisters 352 slide over an upper portion of the back wall 304 of the sleeve 300, which has a double wall-thickness of sleeve material 319 formed by the top middle flap 234 being secured to the middle major panel 230 of the layout 16. A sleeve-catch 318, located in FIGS. 14-16 at the right end of the sleeve 300, slides over the surface of the tray opposite the product-encasing blisters 352 as the tray 350 is moved in or out of the sleeve 300. The tray 350 may be moved to the fully extended position of FIG. 16 so that all of the blisters 352 on the tray 350 are available and accessible to the user. When the tray 350 is moved to the fully extended position, the locking portion 354 at the left end (relative to the FIG. 16) of the tray 350 that previously locked the tray 350 in a fully enclosed position now catches, in a hooking manner, on the sleeve-catch 318 of the sleeve 300 and prevents complete removal of the tray 350 from the sleeve 300. After the user releases the product from a blister 352 on the tray 350, such as by rupturing a membrane that seals the blister 352 closed, the user can easily return the tray 350 to the fully locked condition within the sleeve 300 by sliding the tray 350 back into the sleeve 300 to the position of FIGS. 12, and 14, thus making the blisters 352 once again inaccessible to the user.

Thus, there is shown and described a lockable product package assembly and product package lock system, formed into a single integrated package, which is released from a locked condition through the use of a release button mechanism. An inner tray containing medications or other products is released from a locked condition within an outer sleeve by depressing the release button. The inner tray may thus be slidably moved from an inaccessible position inside the sleeve, wherein the products in/on the sleeve are not accessible to a user, to an accessible position outside of the sleeve, wherein the tray extends from an open top end of the sleeve permitting access to the products in/on the tray. The tray is prevented from being completely removed from within the sleeve by the engagement, in a hooking-manner, of a sleeve-catch in the sleeve with a locking portion of the tray. The sleeve may be placed back into the locked position by slidably moving the tray back inside the sleeve, wherein at least a locking portion of the tray engages a recess on the inner surface of the sleeve, creating an interference fit between the locking portion and the recess. The interference fit prevents the removal of the tray until the release button located on the locking portion of the tray is depressed, thus moving the locking portion out of engagement with the recess in the sleeve.

Although other modifications and changes may be suggested by those skilled in the art, it is the intention of the inventors to embody within the patent warranted hereon all changes and modifications as reasonably and properly come within the scope of their contribution to the art.

What is claimed is:

1. A lockable product package assembly, comprising:

an outer sleeve having a first wall with an inner surface, said inner surface of said first wall defining a tray locking recess; and a unitary inner tray configured to slidably engage within said outer sleeve, said inner tray including, a product portion, and a locking portion integrally formed with and connected to said product portion, said locking portion having a first surface and a second surface opposite the first surface, said locking portion including a protruding release-button integrally formed as a hollow blister in said locking portion, wherein said protruding release button protrudes from said first surface of said locking portion, said locking portion being configured to engage with said tray locking recess to prevent sliding movement of said tray beyond a fully inserted position in said sleeve when said inner tray is fully inserted into said outer sleeve, said fully inserted position preventing access to said product portion, and said locking portion of said tray being disengaged from said recess in said outer sleeve when said protruding release-button is depressed, so as to permit sliding movement of said tray from said fully inserted position to a product access position, permitting access to said product portion.

2. The lockable product package assembly of claim 1, wherein said outer sleeve defines a release-button opening disposed in said first wall.

3. The lockable product package assembly of claim 2, wherein, said protruding release-button of said inner tray is accessible through said release-button opening in said outer sleeve when said inner tray is in said fully inserted position inside of said sleeve.

4. The lockable product package assembly of claim 2, wherein, said protruding release-button of said inner tray protrudes through said release-button opening in said outer sleeve when said inner tray is in said fully inserted position inside of said sleeve.

5. The lockable product package assembly of claim 1, wherein said outer sleeve further includes an integrally connected sleeve-catch disposed within said outer sleeve, said sleeve catch engaging said locking portion of said inner tray when said tray is in a fully extended position.

6. The lockable product package assembly of claim 5, wherein said outer sleeve comprises a plurality of integrally connected walls that together form a substantially closed sleeve having an open top end, and wherein said sleeve-catch is positioned adjacent to said open top end of said outer sleeve.

7. The lockable product package assembly of claim 5, wherein said locking portion of said inner tray is configured to engage said sleeve-catch in said outer sleeve when said inner tray is in said fully extended position, so as to prevent complete withdrawal of said inner tray from said outer sleeve.

8. The lockable product package assembly of claim 1, wherein said outer sleeve further includes a locking-edge disposed at a perimeter of said recess in said outer sleeve, and a lock-edge disposed at a free end of said locking portion of said inner tray, said lock-edge of said inner tray engaging said locking-edge in said outer sleeve when a pulling force is extended on said tray while said tray is in a locked condition and in the fully inserted position to prevent movement of said inner tray from the fully inserted position.

9. The lockable product package assembly of claim 1, wherein said outer sleeve further comprises a deformable portion adjacent said release button that is selectively deformable so as to depress said release button of said inner tray.

10. A lockable product package assembly comprising:

an outer sleeve having a first wall with an inner surface, said inner surface of said first wall defining a tray locking recess; and a unitary inner tray configured to slidably engage within said outer sleeve, said inner tray including, a product portion, and a locking portion integrally formed with and connected to said product portion, said locking portion having a first surface and a second surface opposite the first surface, said locking portion including a protruding release-button integrally formed as a hollow blister in said locking portion, wherein said protruding release button protrudes from said first surface of said locking portion, said product portion of said inner tray being locked within said sleeve when said inner tray is slidably inserted to a fully inserted position inside said sleeve and said locking portion engages said tray locking recess, said product portion being inaccessible in said fully inserted position, and said product portion of said inner tray being accessible to a user when extended from said fully inserted position to an accessible position, permitting access to said product portion by the user, said inner tray being movable from said fully inserted position when said protruding release-button has been depressed, disengaging said locking portion from said recess in said outer sleeve.

11. A lockable product package assembly, comprising:

an outer sleeve having a first wall with an inner surface, said inner surface of said first wall defining a tray locking recess; and a unitary inner tray formed from a single continuous card having a plurality of hollow blisters integrally formed thereon, said tray configured to slidably engage within said outer sleeve, said inner tray including, a product portion having a first end and one or more of said plurality of hollow blisters integrally formed in said product portion and protruding from a first surface of said product portion, a locking portion integrally formed with said product portion, said locking portion being hingedly connected by a first end thereof to said first end of said product portion, said locking portion including a protruding release-button integrally formed in said locking portion as one of said plurality of hollow blisters, wherein said protruding release button protrudes from a first surface of said locking portion, said protruding release button and said hollow blisters in said product portion being located on a same side of said tray when said product portion and locking portion are aligned in a flat unfolded configuration, said locking portion being configured to engage with said tray locking recess to prevent sliding movement of said tray beyond a fully inserted position in said sleeve when said locking portion is in a folded configuration relative to said product portion of said inner tray and said inner tray is fully inserted into said outer sleeve, said fully inserted position preventing access to said product portion, and said locking portion of said tray being disengaged from said recess in said outer sleeve when said protruding release-button is depressed, so as to permit sliding movement of said tray from said fully inserted position to a product access position, permitting access to said product portion.

* * * * *